United States Patent [19]

Ascoli

[11] 4,144,429

[45] Mar. 13, 1979

[54] MANUALLY OPERATED ELECTRICAL SWITCH

[75] Inventor: Enzo Ascoli, Lausanne, Switzerland

[73] Assignee: The Gillette Company, Boston, Mass.

[21] Appl. No.: 859,614

[22] Filed: Dec. 12, 1977

[51] Int. Cl.[2] ..... H01H 1/36

[52] U.S. Cl. ..... 200/164 R; 200/67G; 200/260

[58] Field of Search ..... 200/51.07, 51.08, 164 R, 200/260, 67 G

[56] References Cited

U.S. PATENT DOCUMENTS

| | | | |
|---|---|---|---|
| 774,391 | 11/1904 | Kleber | 200/51.07 X |
| 1,044,270 | 11/1912 | Shaler | 200/51.07 X |
| 1,603,247 | 10/1926 | Ryder | 200/51.08 X |
| 2,095,175 | 10/1937 | Douglas | 200/260 X |
| 2,149,049 | 2/1939 | Gough | 200/51.07 |
| 2,535,002 | 12/1950 | Weber | 200/51.07 |
| 2,857,570 | 10/1958 | Simpson | 200/51.07 X |
| 3,098,133 | 7/1963 | Van Den Driest | 200/51.07 |
| 3,281,545 | 10/1966 | Pierce | 200/67 G X |
| 3,695,598 | 9/1972 | Nishikawa et al. | 200/67 G |

*Primary Examiner*—Herbert F. Ross

*Attorney, Agent, or Firm*—Richard A. Wise; Donald E. Mahoney

[57] ABSTRACT

A manually operated electrical switch includes a first conductor and a second conductor. The second conductor is telescopically coupled to an electrical contact arranged to be spring biased against an opposing surface. The second conductor is attached to an electrical insulator and assembled in a housing so as to be pivotally movable over an arcuate path between a first position in which the first conductor is in electrical contact with the second conductor and a second position in which the first conductor is electrically insulated from the second conductor.

11 Claims, 6 Drawing Figures

MANUALLY OPERATED ELECTRICAL SWITCH

BACKGROUND OF THE INVENTION

1. Field of the Invention

This invention relates generally to electrical switches, and more particularly to a manually operated electrical switch.

2. Description of the Prior Art

Manually operated electrical switches are employed in small electrical appliances, such as electric shavers, for making and breaking an electrical connection between an electrical circuit disposed within an appliance housing, and appliance input terminals adapted to mate with a typical miniature appliance connector attached to one end of a power cord. The prior art manually operated appliance switches include a movable member, such as a button, located on an external surface of the appliance housing for causing an intermediate electrical conductor to selectively make or break an electrical connection between the appliance input terminals and the appliance electrical circuits. It is sometimes desirable to eliminate buttons or other types of movable members from the external surface of the appliance housing leaving only the appliance input terminals. In addition, it is also desirable to decrease the number of switch parts while providing a positive electrical connection between the appliance input terminals and the appliance electrical circuits.

Accordingly, a manually operated switch is arranged to provide an electrical connection between the appliance input terminals and the appliance electrical circuits without using an intermediate movable member located on the external housing of the appliance.

SUMMARY OF THE INVENTION

A manually operated switch comprises a first electrical conductor means having a socket at one end, and a housing in which an electrical insulating member is assembled to pivotally move over an arcuate path. Second electrical conductor means are fixedly attached to the insulating member with contact means telescopically coupled to the second electrical conductor means. Bias means are coupled to the second electrical conductor and the contact means for directing a contact end against an opposing surface. The contact end is detachably received in the socket and in a notch in the housing when the second electrical conductor means is selectively moved over the arcuate path between the socket and the notch. The notch is electrically insulated from the first electrical conductor means.

DESCRIPTION OF THE PREFERRED EMBODIMENT

Figure 1:
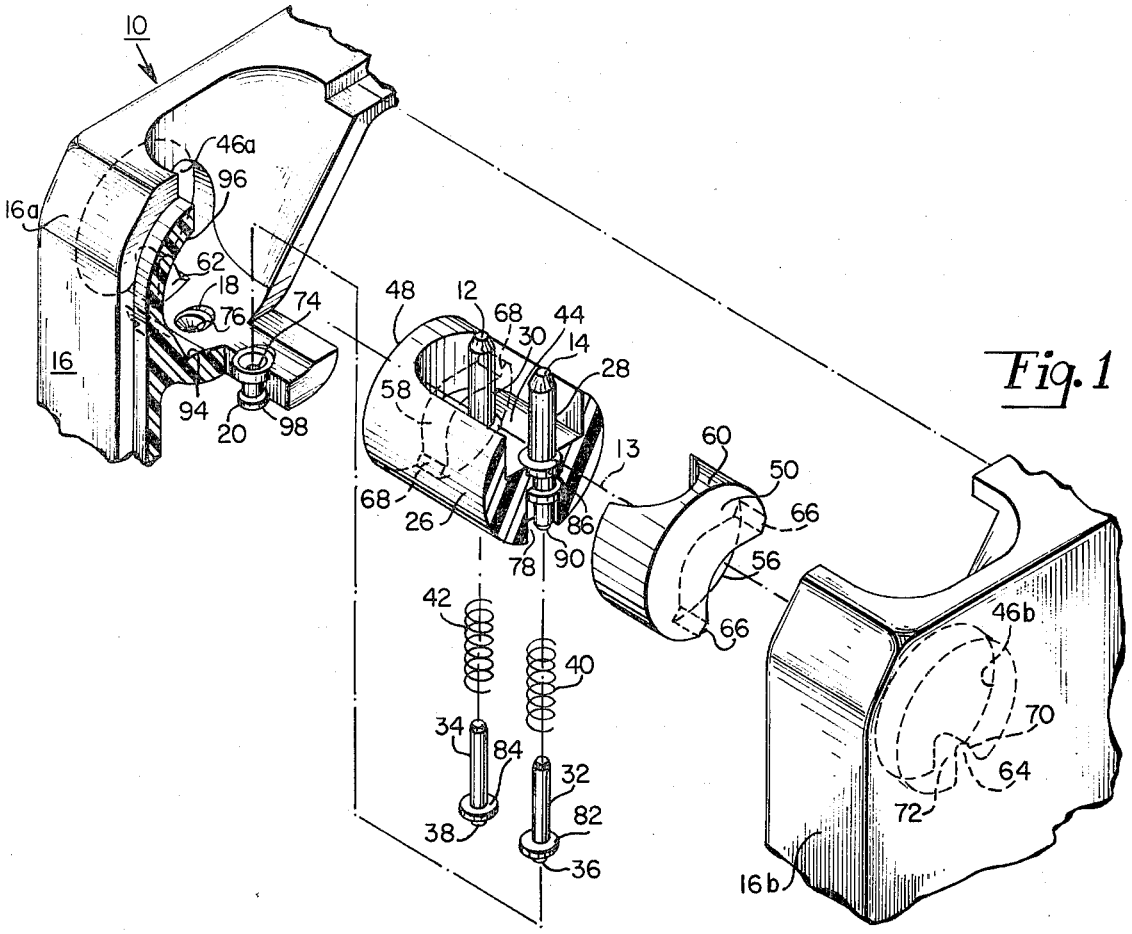
FIG. 1 is an exploded view, partially in section, of a switch arranged according to the invention.

Referring to the drawing in general, there is shown one embodiment of an electrical switch 10 arranged according to the invention. The switch 10 comprises a pair of coplanar electrical input terminals 12, 14 movably assembled in a housing 16 and a pair of electrical output terminals 18, 20 fixedly attached to the housing 16. The input terminals 12, 14 are arranged to be detachably connected to a prior art electrical connector 22 (FIGS. 4 and 5) usually affixed to one end of a power supply cord 24. A force, F, acting against the connector 22 or input terminals 12, 14 in a direction substantially normal to the plane of the input terminal 12, 14 pair causes the input terminals 12, 14 to pivotally move over an arcuate path between first and second positions. The input terminals 12, 14 pivotally move about a pivot axis 13 substantially normal to the longitudinal axes of the input terminals 12, 14. In the first or ON position, the input 12, 14 and output terminals 18, 20 are in electrical contact with each other. In the second or OFF position, the input 12, 14 and output 18, 20 terminals are electrically insulated from each other. In the preferred embodiment, the input terminals 12, 14 are electrical conductors securely held in place by a cylindrical member 26 constructed from insulating material, such as plastic. The cylindrical member 26 is mounted in the housing 16 so as to reciprocally move the input terminals 12, 14 over an arcuate path between the ON and OFF positions in response to the aforementioned applied force, F.

The input terminals 12, 14 include first and second hollow pins 28, 30 respectively in electrical contact with first and second spring loaded rods 32, 34. The rods 32, 34 are slidably disposed within the fist and second hollow pins 28, 30 with projecting rod ends 36, 38 forced against an opposing surface by springs 40, 42. The spring loaded rods 32, 34 are adapted to telescopically move within the hollow pins 28, 30. The output terminals 18, 20 are electrical conductors adapated to detachably receive the rod ends 36, 38 when the input terminals 12, 14 are pivotally moved about the pivot axis 13 to the ON position. It will be understood that various electrical circuitry could be electrically connected to the output terminals 18, 20, whereby electrical energy in the connector 22 from a source, not shown, may be coupled to the electrical circuitry via the switch 10.

Figure 2:
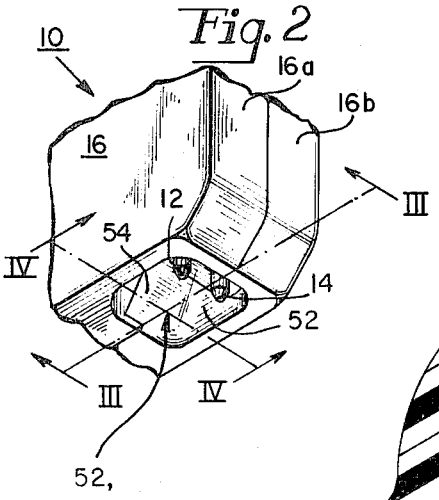
FIG. 2 is a perspective view of the assembled switch.

Referring to FIGS. 1 and 2 there is shown an exploded view, partially in section, of the switch 10 and a perspective view of the switch 10 when assembled. As an example, and not a limitation, the swtich 10 is shown to have male projecting input terminals 12, 14 or pins arranged to mate or connect with a well known miniature female connector 22, further described in "Appliance Couplers for Household and Similar General Purposes," International Electrotechnical Commission, Geneva, Switzerland, Publication 320, first edition, 1970. The male input terminals 12, 14 are disposed within an aperture 44 in the cylindrical member 26 so as to be substantially normal to a longitudinal axis of the cylindrical member 26. The aperture 44 is selected to provide lateral support for the female connector 22, when connected to the input terminals 12, 14. The housing 16 includes first and second complementary halves **16*a*, 16*b* constructed from insulating material such as plastic. Each half 16*a*, 16*b* has a circular hole 46*a*, 46*b* in an internal wall for receiving an end 48, 50 of the cylindrical member 26. The housing halves 16***a*, 16*b* are assembled together with the cylindrical member ends 48, 50 disposed in the holes 46*a*, *46b* so that the cylindrical member 26 may freely pivot about axis 13 over a predetermined angle, $\alpha$, without binding. The assembled housing 16 forms an aperture 52 suitable for receiving the mating connector 22 and permitting the same to be pivotally moved over the predetermined angle, $\alpha$, without interference. For this reason, the aperture 52 has an internal wall 54 sloping at substantially the angle, $\alpha$, measured from the switch ON position.

Means for limiting the angle of pivotal movement, $\alpha$, of the cylindrical member 26 include coaxial semi-circular concavities 56, 58 formed in the curved surface 60 and ends 48, 50 of the cylindrical member 26, and a protuberance 62, 64 in each of the circular holes 46*a*, 46*b* in the housing 16. The protuberances 62, 64 are designed to normally fit within the concavities 56, 58 without touching a curved surface of the concavities 56, 58. When the cylindrical member 26 is pivotally moved over the angle, $\alpha$, substantially flat coplanar surfaces 66, 68 on the member 26 permit a concavity wall to move against a bearing surface 70, 72 of the protuberances 62, 64, thereby preventing further rotation of the member 26.

Figure 3:
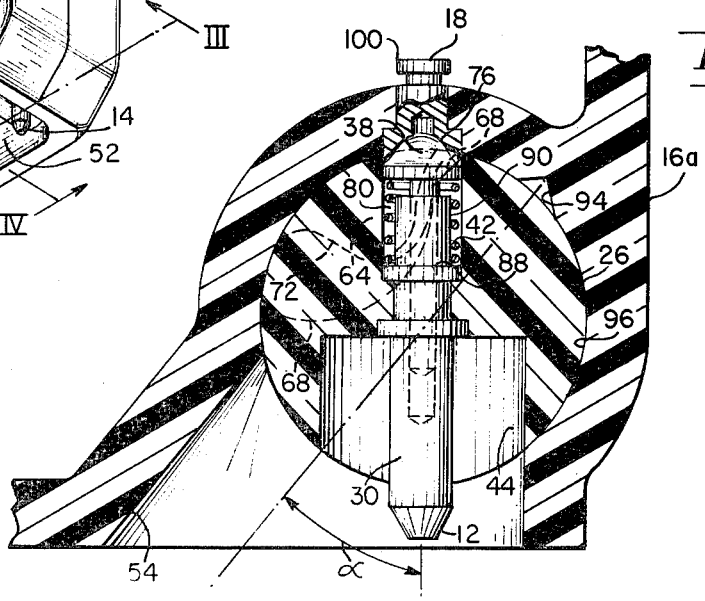
FIG. 3 is a cross sectional view of the switch in the ON position taken along lines III—III of FIG. 2.
Figure 4:
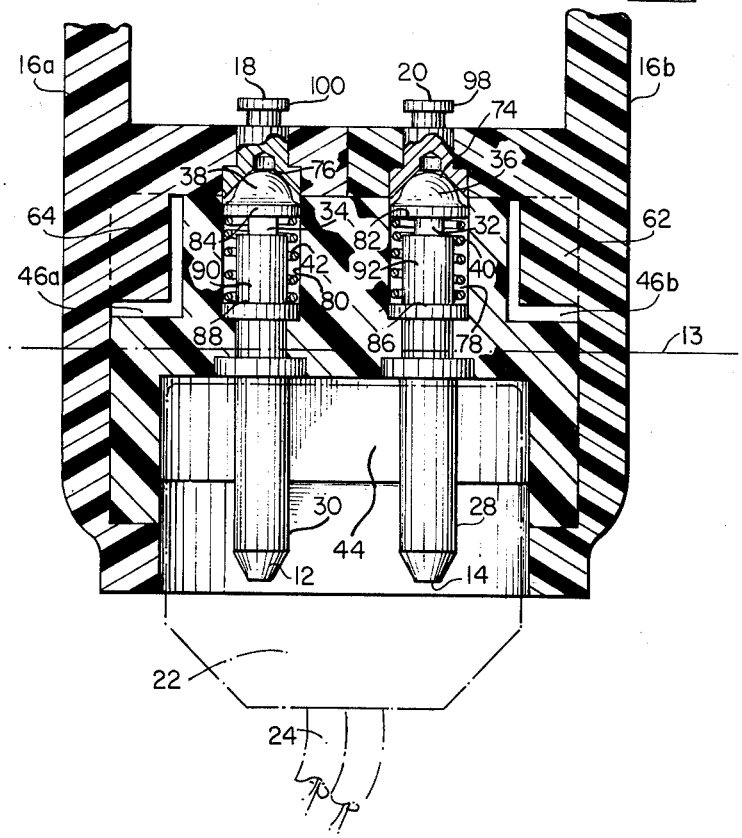
FIG. 4 is a cross sectional view of the switch in the ON position taken along lines IV—IV of FIG. 2.

Referring to FIGS. 3 and 4, there is shown a cross section and a front view, partially in section, of the assembled switch 10 with the input terminals 12, 14 rotated to the ON position. Conical shaped sockets 74, 76 are formed in the ends of the output terminals 20, 18 embedded in the housing 16. The sockets 74, 76 are adapted to detachably receive hemispherical shaped rod ends 36, 38 that project from the hollow pins 28, 30. The coil spring 40, 42 is assembled in a hole 78, 80 in the cylindrical member and compressed between a lip 82, 84 on the rod end 36, 38 and a lip 86, 88 on the pin end 90, 92. The compressed springs 40, 42 provides sufficient bias force to move the rod ends 36, 38 against an opposing surface. In the ON position the compressed springs 40, 42 force the rod ends 36, 38 to be in friction contact with the surface of the output terminal sockets 74, 76. The bias force provided by the coil spring 40, 42 and the complementary hemispherical shaped surfaces of the rod ends 36, 38 and output terminal sockets 74, 76 are selected to require a predetermined force to move the rod ends 36, 38 out of the sockets 74, 76 to prevent the rod ends 36, 38 from prematurely slipping out of the sockets 74, 76.

Figure 5:
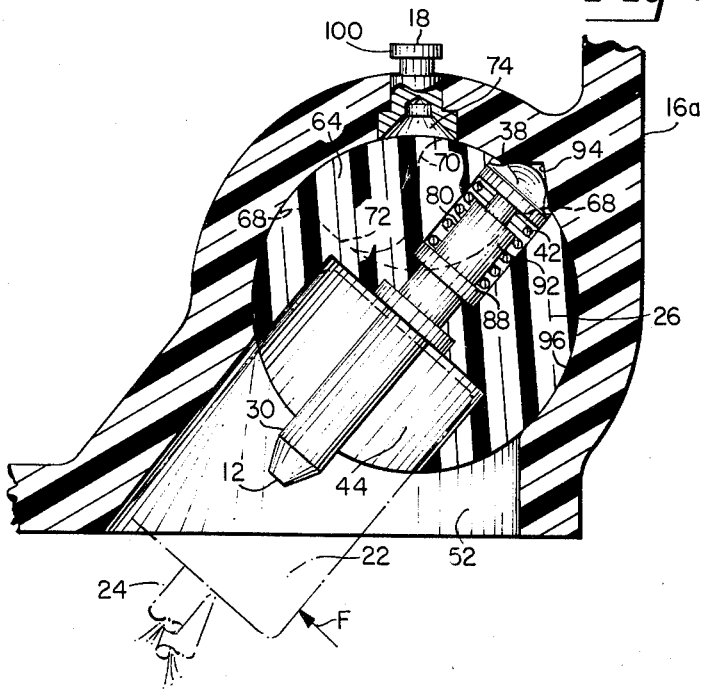
FIG. 5 is a cross sectional view of the switch in the OFF position taken along lines III—III of FIG. 2.

Referring to FIG. 5, there is shown a cross section of the assembled switch 10 with the input terminals 12, 14 in the OFF position. The cylindrical member 26 and input terminals 12, 14 are pivotally moved, over the angle $\alpha$, from the ON position to the OFF position where the rod ends 36, 38 are received in a notch 94 in the internal wall 96 of the housing 16. In the OFF position, the rod ends 36, 38 are electrically insulated from the output terminals 18, 20 by the electrically non-conducting material of the housing 16. In an alternative embodiment, the notch 94 may be formed in a section of non-conducting material embedded in the internal wall 96 of a housing 16 constructed from electrically conducting material.

An an example, the switch 10 may be assembled in a prior art electric shaver, wherein the switch housing 16 is the external housing of the shaver. Electrical circuitry, not shown, for driving a motor in response to an electrical signal may be connected to output terminal ends 98, 100 disposed within the shaver housing by any conventional method, whereby the switch 10 may be used to selectively energize the motor.

Figure 6:
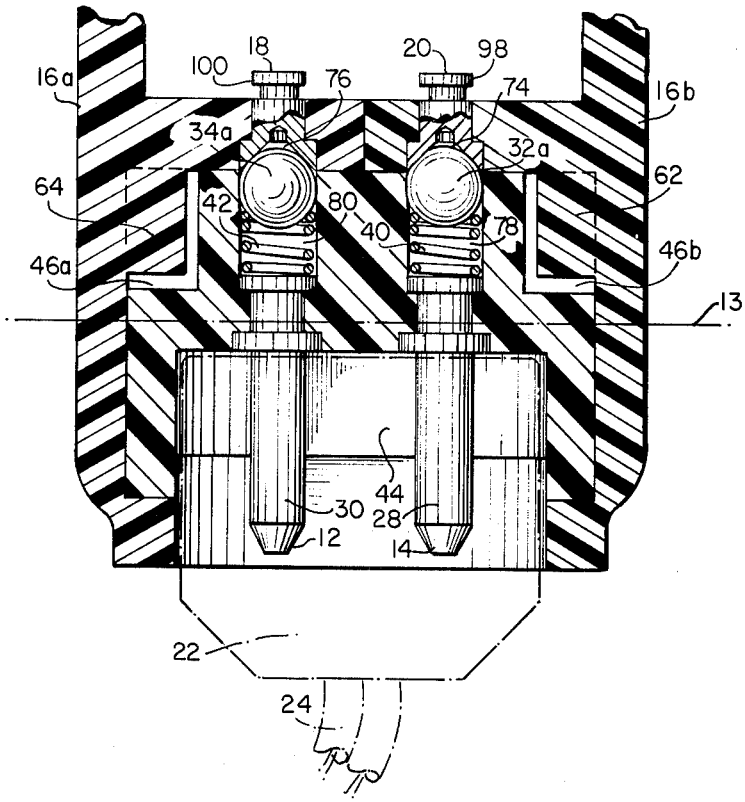
FIG. 6 is a cross sectional view of the switch in the OFF position showing contact means in the form of a sphere.

A preferred embodiment of the invention has been shown and described. Various other embodiments and modifications thereof will be apparent to those skilled in the art. For example, the power cord and connector may not be detachable but instead formed integrally with the switch. In another embodiment of the invention shown in cross section in FIG. 6, the rods 32 and 34 are replaced by spheres 32*a* and 34*a* slidably disposed within the holes 78, 80 and forced against an opposing surface by the springs 40, 42. Like the spring loaded rods 32, 34 the spheres 32*a*, 34*a* are adapted to reciprocally move along a linear path within the holes 78, 80 to provide a current conducting path between the input terminals 12, 14 and the output terminals 18, 20 when the spheres are received in the sockets 74, 76 and the switch 10 is in the ON position. Likewise, the spheres are received in the notch 94 when the switch 10 is in the OFF position.

What is claimed is:

1. A manually operated switch comprising:

a housing having an aperture and a protuberance in said aperture;

an electrical insulating member assembled in said housing to pivotally move about a predetermined axis, said insulating member having an end with a concavity and a bearing surface formed thereon, said insulating member end being assembled in said aperture in said housing with said protuberance fitting within said concavity so that said bearing surface touches said protuberance when said electrical insulating member is pivotally moved over a predetermined angle, thereby limiting said pivotal movement of said insulating member;

first electrical conductor means for conducting electrical energy, said first electrical conductor means having a socket at one end and being fixedlly attached to said housing;

second electrical conductor means for conducting electrical energy, said second electrical conductor means being fixedly attached to said insulating member with a longitudinal axis substantially normal to said predetermined axis;

contact means for conducting electrical energy, said contact means being telescopically coupled to said second electrical conductor; and bias means coupled to said second electrical conductor and said contact means for directing a contact end against an opposing surface, said contact end being detachably received in said socket and in a notch in said housing when said second electrical conductor means is pivotally moved about said predetermined axis over said predetermined angle between said socket and said notch, said notch being electrically insulated from said first electrical conductor means.

2. A manually operated switch according to claim 1, wherein said second electrical conductor means include a hollow conductor embedded in said insulating member.

3. A manually operated switch according to claim 2, wherein said contact means include a rod adapted to telescope into said hollow conductor.

4. A manually operated switch according to claim 1, wherein said contact end is hemispherically shaped.

5. A manually operated switch according to claim 1, wherein said socket is conically shaped.

6. A manually operated switch according to claim 1, wherein said bias means is a coil spring assembled between second electrical conductor means and said contact end to provide a bias force for directing said contact end against said opposing surface.

7. A manually operated switch according to claim 1, wherein said housing is constructed from insulating material.

8. A manually operated switch comprising:

a housing having an aperture and a protuberance in said aperture;

an electrical insulating member assembled in said housing to pivotally move about a predetermined axis, said insulating member having an end with a concavity and a bearing surface formed thereon, said insulating member end being assembled in said aperture in said housing with said protuberance fitting within said concavity so that said bearing surface touches said protuberance when said electrical insulating member is pivotally moved over a predetermined angle, thereby limiting said pivotal movement of said insulating member;

first electrical conductor means for conducting electrical energy, said first electrical conductor means having a socket at one end;

second electrical conductor means for conducting electrical energy, said second electrical conductor means being fixedly attached to said insulating member with a longitudinal axis substantially normal to said predetermined axis;

contact means for conducting electrical energy, said contact means being movably coupled to said second electrical conductor;

bias means coupled to said second electrical conductor and said contact means for directing a contact end against an opposing surface, said contact end being detachably received in said socket and in a notch in said housing when said second electrical conductor means is pivotally moved about said predetermined axis over said predetermined angle between said socket and said notch, said notch being electrically insulated from said first electrical conductor means; and connector means coupled to said second electrical conductor means for pivotally moving said electrical insulating member and said second electrical conductor means about said predetermined axis in response to a force applied against said connector means.

9. A manually operated switch according to claim 8, wherein said connector means include a female electrical connector detachably coupled to said second electrical conductor means.

10. A manually operated switch according to claim 8, wherein said connector means is integrally formed with said second electrical conductor means.

11. A manually operated switch according to claim 8, wherein said contact means include a sphere.

* * * * *